US010267147B2

(12) United States Patent
Healy et al.

(10) Patent No.: US 10,267,147 B2
(45) Date of Patent: Apr. 23, 2019

(54) SURFACE ACCESS BOREHOLE RESOURCE EXTRACTION METHOD

(71) Applicant: AREVA Resources Canada Inc., Saskatoon (CA)

(72) Inventors: Daylan Healy, Saskatoon (CA); Louis-Pierre Gagnon, Saskatoon (CA); Sylvain Eckert, Antony (FR); Tyson Pederson, Warman (CA)

(73) Assignee: AREVA Resources Canada Inc., Saskatoon, Saskatchewan (CA)

( * ) Notice: Subject to any disclaimer, the term of this patent is extended or adjusted under 35 U.S.C. 154(b) by 505 days.

(21) Appl. No.: 15/108,029

(22) PCT Filed: Dec. 31, 2013

(86) PCT No.: PCT/CA2013/001090
§ 371 (c)(1),
(2) Date: Jun. 24, 2016

(87) PCT Pub. No.: WO2015/100481
PCT Pub. Date: Jul. 9, 2015

(65) Prior Publication Data

US 2016/0326871 A1 Nov. 10, 2016

(51) Int. Cl.
*E21B 7/18* (2006.01)
*E21C 37/12* (2006.01)
(Continued)

(52) U.S. Cl.
CPC ..... *E21C 37/12* (2013.01); *E21B 7/00* (2013.01); *E21B 43/29* (2013.01); *E21B 43/34* (2013.01); *E21C 45/00* (2013.01); *E21B 7/18* (2013.01)

(58) Field of Classification Search
CPC ..... E21B 7/18; E21B 43/29; E21B 43/34; E21C 45/00; E21C 37/12
See application file for complete search history.

(56) References Cited

U.S. PATENT DOCUMENTS 2,720,390 A * 10/1955 Brooks ..... E21B 43/292 175/284
3,402,967 A * 9/1968 Edmonds ..... E21B 43/292 137/355.28

(Continued)

FOREIGN PATENT DOCUMENTS

CA 2008393 C 7/1990
CA 2645707 A1 6/2010

OTHER PUBLICATIONS

International Search Report pertaining to PCT/CA2013/001090 with a filing date of Dec. 31, 2013.

*Primary Examiner* — Sunil Singh
(74) *Attorney, Agent, or Firm* — Dinsmore & Shohl LLP

(57) ABSTRACT

A non-human-entry method for extracting a desired subsurface material such as ore, wherein an access hole is drilled from surface downwardly to the material, a high-pressure fluid injection tool is lowered with or after the drill string to the material and injected outwardly to disaggregate the material and form a cavity, and the material is optionally ground to a desired size by a drill bit or other means to enable suction up production tubing with a carrier fluid to the surface. The injection tool and grinding means are preferably part of an integrated bottom hole assembly at the lowermost end of a drill string, which may include surveying equipment to measure the cavity dimensions at intervals during target material disaggregation to allow fluid injection adjustment to seek to achieve a desired cavity geometry. Deck cementing is optionally employed for ground support.

19 Claims, 6 Drawing Sheets

(51) Int. Cl.

| | |
|---|---|
| ***E21B 43/29*** | (2006.01) |
| ***E21B 7/00*** | (2006.01) |
| ***E21B 43/34*** | (2006.01) |
| ***E21C 45/00*** | (2006.01) |

(56) References Cited

U.S. PATENT DOCUMENTS

| | | | | |
|---|---|---|---|---|
| 5,246,273 | A * | 9/1993 | Rosar | E21B 43/28 175/45 |
| 2013/0106166 | A1* | 5/2013 | Gilmore | E21B 43/292 299/17 |
| 2016/0084083 | A1* | 3/2016 | Hice | E21B 7/18 299/1.05 |

* cited by examiner

SURFACE ACCESS BOREHOLE RESOURCE EXTRACTION METHOD

FIELD OF THE INVENTION

The present invention relates to methods and techniques for extracting subsurface materials such as ores, and more particularly to extraction methods involving excavation.

BACKGROUND OF THE INVENTION

Mineralized ore such as uranium deposits is currently mainly accessed from subsurface locations using two different techniques that have been utilized for centuries. First, open pit mining uses large earth-moving equipment and blasting techniques to uncover the mineralized ore for removal. Second, underground mining uses underground ramps or shafts to access a level that can utilize standard underground mining machinery to remove the ore and lift or haul it to surface. There are obstacles for such conventional methods when accessing and mining certain ore bodies that are non-conducive to open pit or underground methods.

Open pit mining costs exponentially increase as the mineralized ore target increases in depth, resulting in this method primarily focusing on shallower ore bodies. When open pit mining for uranium in pressurized water saturated ground, dewatering is necessary; certain jurisdictions require treatment of the water prior to release into the environment, which can add significant cost to the mine life. Open pit mining produces a large environmental footprint for the pit and waste rock piles which have to be planned to be decommissioned in an environmentally sustainable way. When mining uranium, workers in the pit are also exposed to higher levels of gamma radiation, radioactive dust and radon gas primarily because of the proximity of the uranium ore to the workers.

Underground mining requires large initial capital outlays prior to production which reduces the economic incentive of this method by pushing out future positive cash flows into the future. An economic problem also exists when resources are too deep to be accessed with conventional open pit processes and the resource estimation is too small to justify underground mine upfront capital costs.

Technical problems also exist in underground mining of water bearing formations that are geo-technically weak and highly permeable. Considerable hydrostatic pressure from the surrounding formation could cause a sudden large water inflow when performing underground works, and in an underground mine setup this may cause at minimum production delays and at maximum risk to worker safety and loss of the mine. Mining uranium ore with a human-entry underground mining method may also pose increased risk to worker safety from a radiation protection point of view depending on uranium grades, geometry of the access, ventilation and exposure time.

What is needed, therefore, is a method that provides an economically sound mining alternative for subsurface deposits and can be applied in a manner that addresses safety issues such as radioactivity of the target ore.

SUMMARY OF THE INVENTION

The present invention accordingly seeks to provide a method for extracting ore through cavity excavation using a hole drilled from surface into the ore body, using high-pressure fluid injection to break up the target material, without the need for open pit or underground mining techniques and with no requirement for human entry into the underground works.

According to a broad aspect of the present invention there is provided a method for excavating a subsurface cavity in a target material to extract a desired part of the target material and produce it to surface, the method comprising the steps of:

a. drilling a hole downwardly from surface to at least the depth of the target material;
b. lowering high-pressure fluid injection means downwardly through the hole to the target material;
c. injecting fluid through the fluid injection means outwardly against adjacent target material;
d. allowing the injected fluid to strike and disaggregate the adjacent target material and form the subsurface cavity;
e. producing the disaggregated target material to the surface through the hole using a carrier fluid; and
f. separating the disaggregated target material from the carrier fluid at the surface.

In some exemplary embodiments of the present invention, the method may comprise the further steps of determining a desired cavity geometry or profile, measuring cavity dimensions and comparing against the desired cavity geometry, and then adjusting injection of the injected fluid in response to the comparison to substantially achieve the desired cavity geometry. The steps of determining, measuring, comparing and adjusting may optionally be repeated a plurality of times until the desired cavity geometry is substantially achieved. The injected fluid is preferably also at least a portion of the carrier fluid used in production, with the carrier fluid reintroduced to the hole as injected fluid after separation from the produced disaggregated target material. The target material preferably comprises a target ore that may be solid, and exemplary methods may allow for processing of the disaggregated target material at the surface to extract the ore therefrom.

In further exemplary embodiments, the method may further comprise the step of reducing the size of the disaggregated target material to a size suitable for production to the surface. Reducing the size may be accomplished by grinding the disaggregated target material by grinding means present downhole of the fluid injection means, and the grinding means may be a drill bit. The hole may also be drilled downwardly to a point below a lowermost extent of the target material to form a sump, the disaggregated material allowed to settle into the sump, and then grinding of the disaggregated target material occurs in the sump.

The fluid injection means may be moved vertically and/or rotationally such that the injected fluid strikes the adjacent target material along a desired path, in order to help achieve the desired cavity geometry, and the fluid injection means may be moved vertically and/or rotationally in repeated sequence. The fluid injection means may also comprise an air shroud adjoining the injected fluid outlet to enhance disaggregation of the target material.

The method preferably comprises drilling the hole with a drill string having a drill bit at a lowermost extent thereof, and the fluid injection means comprising a jet sub having a nozzle on the drill string above the drill bit, and the drill string preferably also comprises surveying means to measure cavity dimensions and producing means such as for example tubing for producing the disaggregated target material.

Producing the disaggregated target material is preferably achieved by means of production tubing within the hole, in order to contain the produced material, which containment would be desirable where the produced material is radioactive or otherwise warrants containment. The production tubing is preferably connected to air supply means, such that producing the disaggregated target material comprises introducing air into the carrier fluid to reduce hydrostatic column density within the tubing and creates upward suction of the carrier fluid and disaggregated target material through the tubing toward the surface.

Exemplary embodiments may further comprise withdrawing all downhole equipment from the hole, and subsequently backfilling the excavated cavity. Where lower target layers have been identified, exemplary methods can include drilling through such backfilling to the second lower target material layer and repeating steps b. through f. above for that second layer.

A detailed description of an exemplary embodiment of the present invention is given in the following. It is to be understood, however, that the invention is not to be construed as being limited to this embodiment.

BRIEF DESCRIPTION OF THE DRAWINGS

In the accompanying drawings, which illustrate an exemplary embodiment of the present invention.

An exemplary embodiment of the present invention will now be described with reference to the accompanying drawings.

DETAILED DESCRIPTION OF EXEMPLARY EMBODIMENT

The present invention is intended for use in the formation of an underground cavity in water saturated, frozen or dry ground utilizing a single access hole from surface, wherein the target material is capable of disaggregation by a down hole water jet. Note that the accompanying drawings are not to scale, and individual parts of a drawing may be out of scale with other parts of the same drawing.

In the exemplary embodiment described herein, this non-human entry method employs a surface pad for drilling, mining, housing of process equipment, the completion of an access hole from surface to the target layer and the excavating of the target layer material. The purpose of the excavation of the target material could be to mine all or selective parts of an ore body, or alternatively and with any necessary modifications to provide ground support for civil engineering works or to be used for storage of nuclear material. The exemplary method is particularly suited for the excavation of a radioactive ore body, in that miners can excavate the ore body without coming into contact with the ore. During excavation the cavity dimensions are measured and dimensional feedback is used to adjust jetting kinematics, and post excavation backfill is placed to complete the abandonment process.

The present invention can aid mining companies in reclassifying ore from currently sub-economic resources to economic reserves by targeting ore bodies that are economically accessible with the present invention, or to extract ores that would currently be potentially inaccessible due to environmental impact or radiation protection issues using conventional mining techniques. The present invention affords the ability to remotely mine ore utilizing tooling that does not require any access from underground for equipment or workers as in underground mining, nor does the present invention require the overburden and rock above the ore body to be entirely removed mechanically as is performed in open pit mining.

Figure 2:
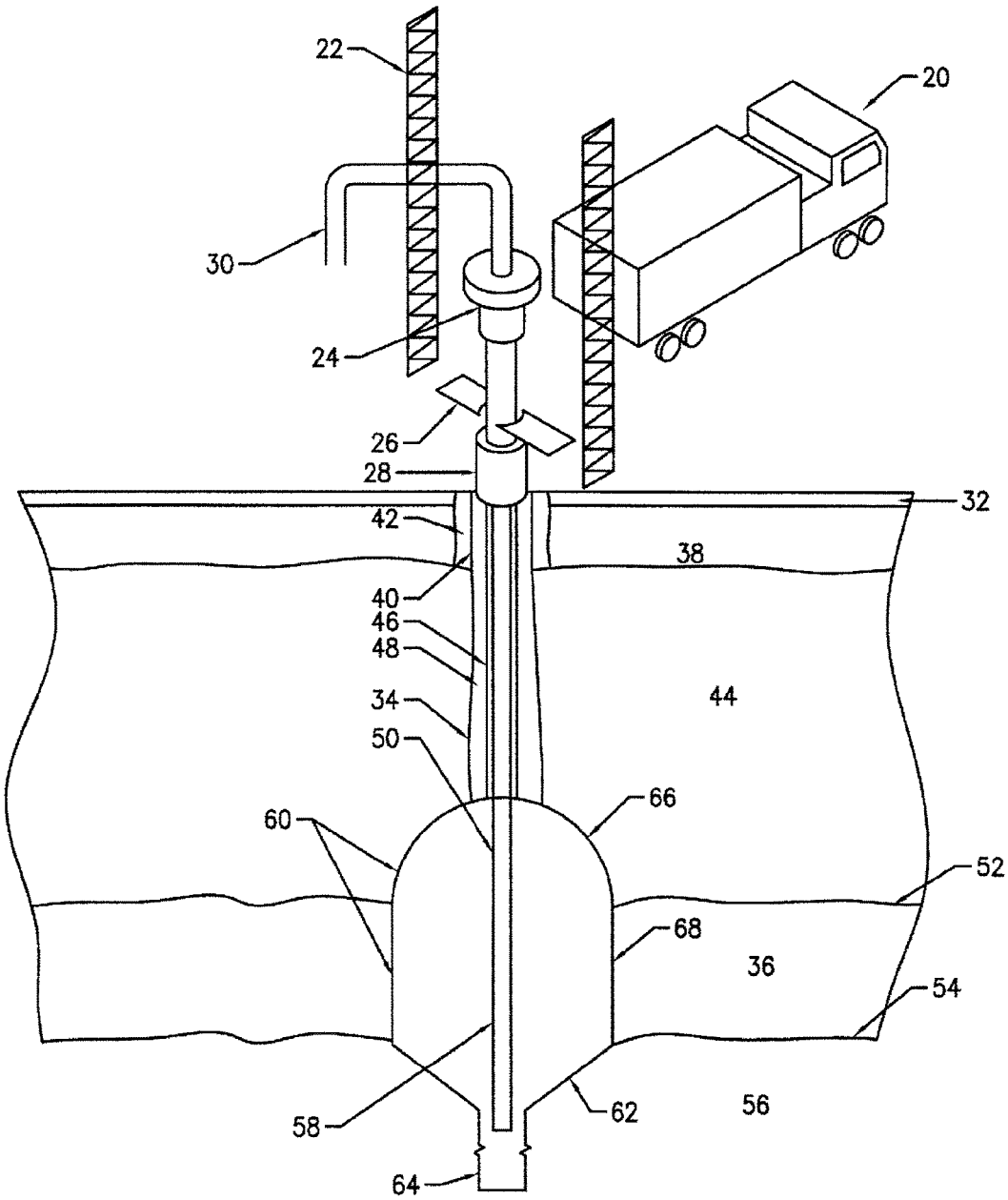
FIG. 2 is an illustration (not to scale) of a drilling arrangement and desired cavity profile according to one embodiment of the present invention.
Figure 4:
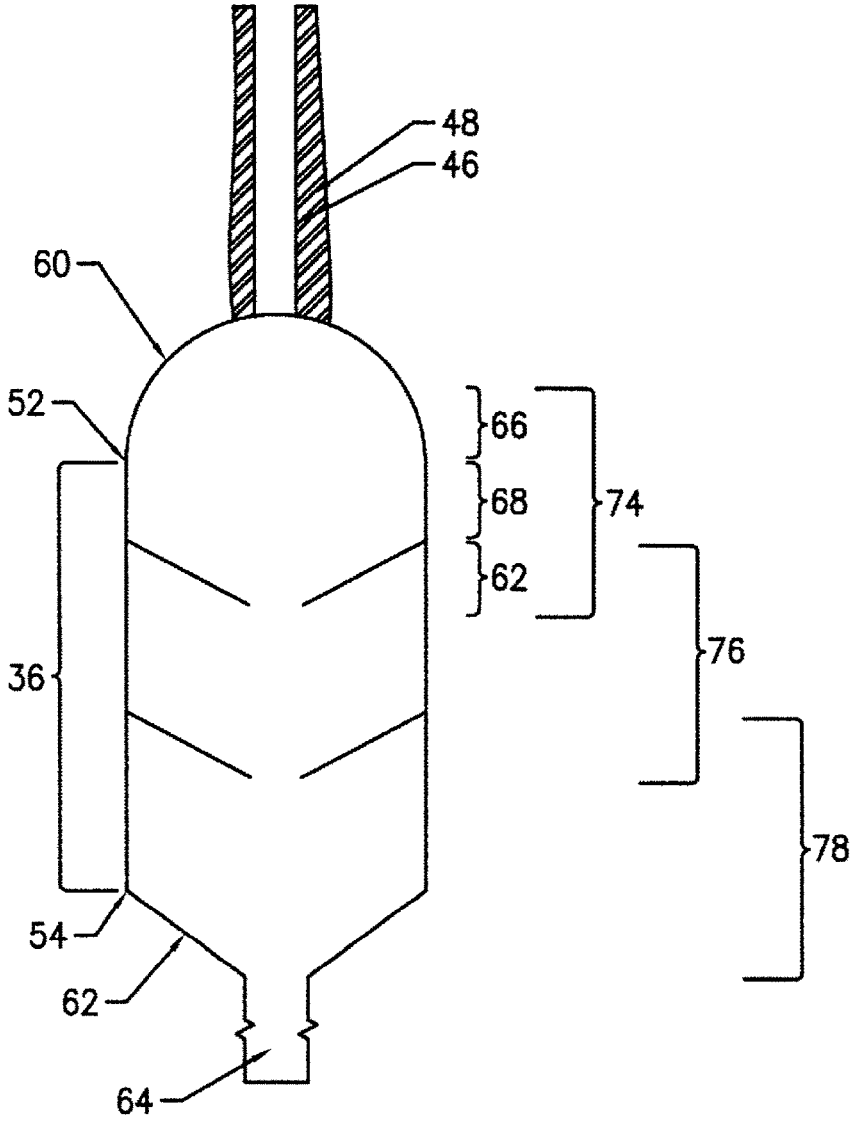
FIG. 4 is a sectional view illustrating downward progression of decks using a single access hole.
Figure 6:
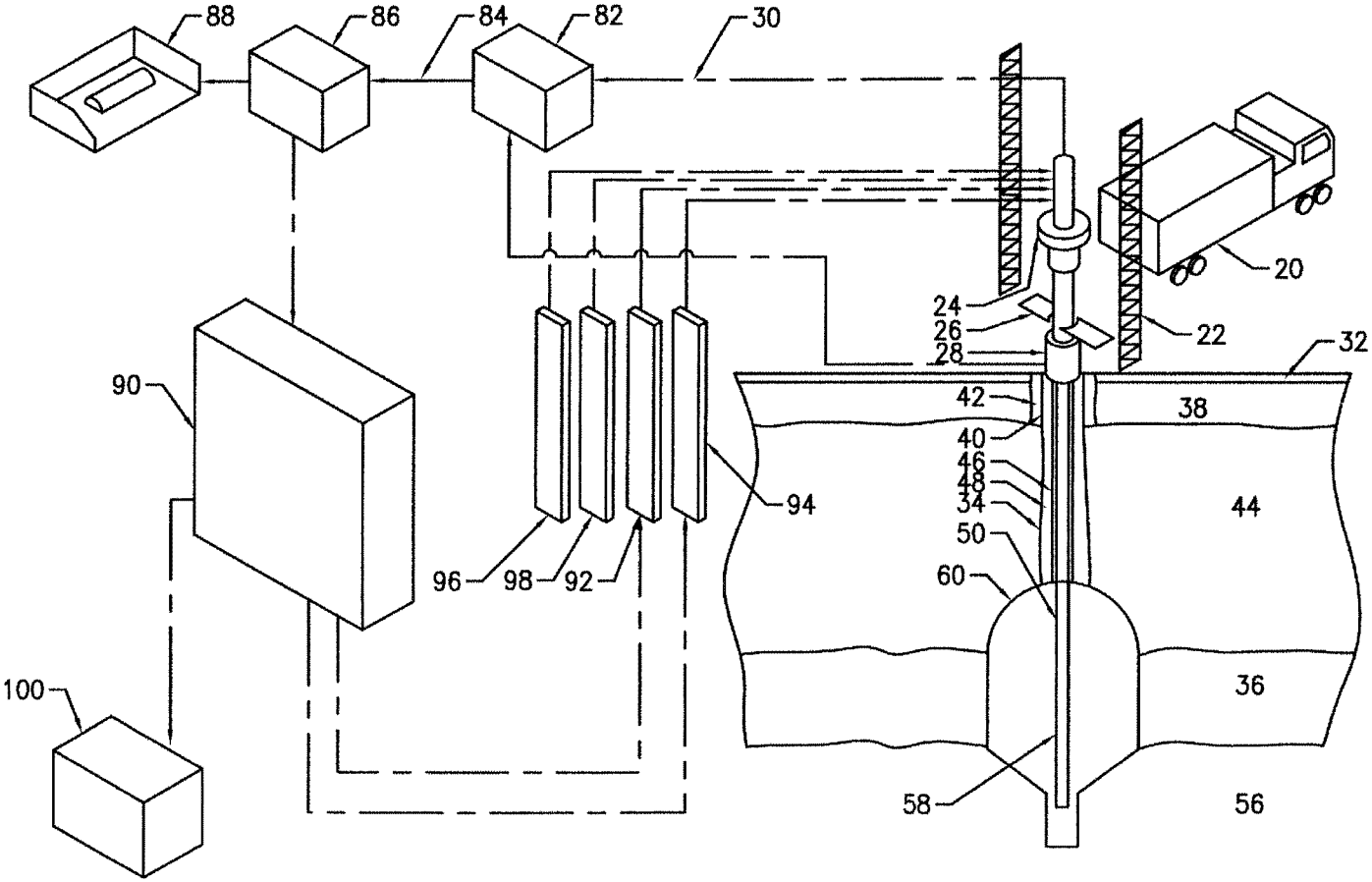
FIG. 6 is an illustration (not to scale) of an exemplary process fluid cycle.

The exemplary method is a surface operated non-human entry mining method that remotely excavates underground mineralized non-frozen or frozen host rock (ore) and produces the ore to surface. Turning to FIG. 2, a drilling arrangement is provided comprising a drilling and mining rig 20, a drill mast 22, drilling and mining head mechanical dynamic control 24, a rig table 26, wellhead 28, production piping 30 to the air and solids separator (shown in FIG. 6), and a drill pad 32 at ground level (which drill pad 32 may be provided with an installed impermeable liner where required in a given jurisdiction). An access hole 34 to the ore body 36 is drilled, cased and completed from surface. The access hole 34 is first drilled through the overburden 38, followed by overburden casing 40 and overburden cementing 42, and it is then drilled downwardly through the upper country rock 44, followed by access hole casing 46 and access hole cementing 48. Tooling 58 is lowered into the access hole with mining pipe 50 (either with the drill string or subsequent to drilling) to an in-hole location adjacent the ore 36 (defined as being between an ore body upper cut-off 52 and an ore body lower cut-off 54, the ore body 36 itself separating the upper country rock 44 and lower country rock 56. The tooling 58 preferably comprises a bottom hole assembly comprising jet nozzles(s), suction means, grinder(s) and a surveyor, as described in detail below. When the tool 58 reaches the desired in-hole position, a high pressure jet nozzle is utilized to disaggregate the adjacent target ore within the ore body 36, allowing the disaggregated ore from the cavity 60 to fall to the bottom of the cavity 62 and subsequently into the sump 64 where it is ground (as necessary to enable production) and lifted to surface within the mining string 50. On surface, the ore is separated from the carrier fluid via the air and ore separators 82, 84 and put into temporary storage on the ore pad 88 where the ore awaits hauling to a milling facility. If advantageous to the mine site setup, the fluids used to carry the ore to surface can be recirculated downhole from the ore separator 86 to disaggregate further ore through the use of the high pressure jet nozzle from within the cavity, as is schematically illustrated in FIG. 6, discussed below. At various points throughout the mining process the cavity 60 eroded by the water jet is measured, and dimensional contours in the cavity 60 can be used to adjust the nozzle kinematics to increase disaggregation efficiency in a manner known to those skilled in the art. Depending on the characteristics of the host rock and the cavity 60 diameter, mining may be performed in decks (vertically-defined cavities) where an upper deck is mined and backfilled and a subsequent lower deck is mined and backfilled, creating a reinforced back in the form of an upper deck cemented backfill, as is illustrated in FIG. 4, discussed below; alternatively, in competent host rock, this deck mining process may be executed from bottom deck to top deck. This subsequent deck mining process can be repeated as desired. Adjoining cavities can be mined once the final deck backfill is placed and set in the access hole being used to mine, as described below.

The term "disaggregation" encompasses all methods whereby material comes away from the cavity walls. This includes but is not limited to high pressure water jet direct pulverization or kerfing and collapsing/spalling due to cavity wall in-situ stresses in combination with fractures and/or eroded weaker matrix material.

The term "adjacent target material" means physically proximate target material. In the case of target material undergoing disaggregation by means of water jetting, the teen is used to refer to target material that is near the water jet but may be at varying actual distances from the water jet during the ongoing excavation process.

The term "interim survey" means any cavity dimensional survey performed between the initial and final excavation survey.

While the following description makes occasional reference to uranium mining and radioactive ore, it will be clear to those skilled in the art that the exemplary method is not limited to such contexts.

The exemplary method in broad terms is as follows:

i. Surface infrastructure setup ii. Access hole completions a. Drilling and completing the conductor casings b. Drilling and completing the access holes iii. Mining process a. Jetting individual ore stopes using high pressure water within a defined depth range b. Grinding the disaggregated material c. Suction of the cavity fluid and eroded material to surface d. Surveying of the cavity e. Proper abandonment of the complete stope or a sectional stope (a deck) with cemented backfill iv. Repeating of the mining process for the targeted decks within the stopes in the ore body v. Decommissioning of the site Each of the above steps will now be described with reference to the accompanying drawings.

Figure 1:
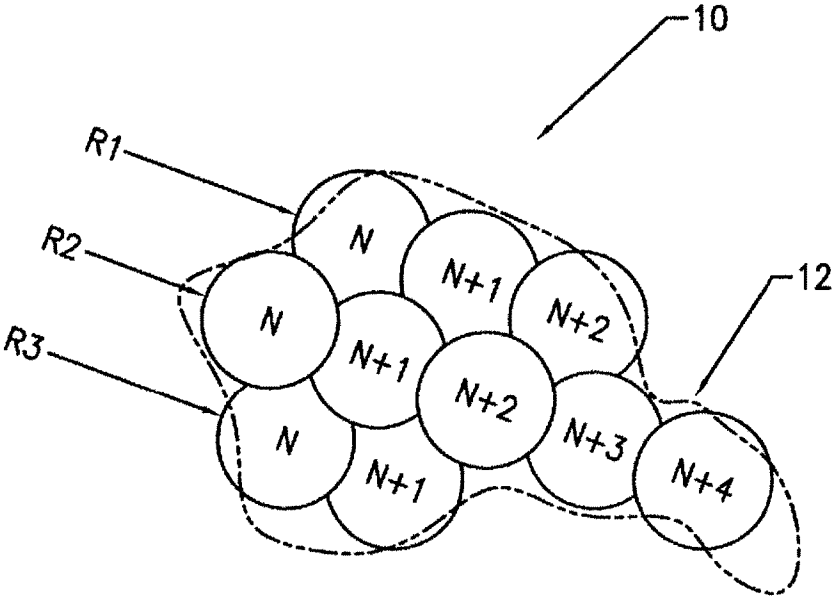
FIG. 1 is a plan view illustrating an exemplary ore body stope targeting.

Stope Targeting. In a preferred embodiment of the present invention, more than one target stope would be excavated. This is illustrated in FIG. 1, where a stope targeting plan. 10 is shown for a determined ore body grade cut-off 12. The order in which the stopes are targeted and mined can be determined by one skilled in the art. For example, as is illustrated in FIG. 1, cavities in target order of $R_2N$, $R_2N+2$, $R_2N+4$, $R_2N+1$, $R_2N+3$, $R_1N$, $R_1N+2$, $R_3N$, $R_1N+1$, $R_3N+1$ etc. could be mined in order where R indicates a row number and N is a constant.

Surface Infrastructure. Infrastructure setup must be within drillable access of the target ore body. Infrastructure can include but is not limited to an access road with a drill pad, ore pad, equipment positioning area, settling ponds or a solids separation system, power supply, site offices, repair, logistics and maintenance shops, etc., as would be known to those skilled in the art.

Access Hole Completions. For vertical access holes a defined grid on surface is followed with appropriate spacing as defined by an economic calculation of the volumetric cuttings rate at a distance from the nozzle and cavity access holes fixed costs and operational costs, and cavity stability calculations. Following are specific steps in the access hole completion activity, with specific reference to FIG. 2.

Stabilizing the overburden. A casing is drilled beyond the overburden 38 at a predetermined spacing on surface for vertical access holes; this can be performed directly prior to access hole 34 drilling or can be performed in advance as part of the upfront capital pad setup. A casing 40 is placed through the overburden 38 into more competent rock 44 below and is cemented in place with overburden casing cement 42 using standard oilfield or water well drilling cementing practices. If the drill pad 32 is designed with secondary containment, the overburden casings 40 must be sealed to the secondary containment liner which is the case for example in uranium mining.

Drilling & completing the access hole. The access hole 34 is required to be drilled within deviation specifications so the tooling 58 used in the later processes can be inserted and rotated without fatiguing the steel, and such deviation specifications are application-specific and within the knowledge of the skilled worker. Within a defined distance above the top intercept 52 of the ore 36 (as modelled in the resource) drill cuttings are collected at intervals, and these cuttings are analysed to define where the actual upper extent 52 of the ore cut-off is. Open hole logging can be performed to confirm deviation and radiometric scanning prior to casing 46 installation. The casing 46 is installed to hold secure the hole diameter for the mining tooling 58 over a defined distance depending above the upper extent ore cut-off 52, and this distance depends in part on geotechnical characteristics of the region. Cementing 48 is then performed on the casing 46 using standard oilfield or water well drilling practices. Cementing 48 serves a triple purpose; it serves primarily to hold and protect the casing 46; it serves secondly to reduce communication of fluids from the cavity 60 by reducing the in-situ permeability surrounding the cavity 60, sealing fractures and improperly abandoned coring holes and sealing the annular space between the casing 46 and the open hole; and it serves thirdly to increase the rock mass strength vertically above the target ore material 36, reducing the potential for collapse from the upper material.

Mining process description. Once surface infrastructure has been set up and the access hole completion is complete, mining can begin. The five main stages (jetting, grinding, suction, surveying and abandonment) are present within the exemplary mining sequence. Performed concurrently are the jetting, grinding and suction processes as a system to disaggregate, reduce ore size and produce ore to surface, although these three actions can also be performed non-concurrently if desired and the specific context is favourable, as would be clear to one skilled in the art in light of the within teaching. Surveying is performed periodically and is used to provide feedback for controlling the high pressure fluid injection, which controlling can be automated using software such as a dimensional control system, in an effort to maximize ore recovery and minimize dilution from outside the cavity 60. Deck cementing is used to support the excavation from above to limit dilution from above as jetting continues below in a lower deck. The mining process steps are described below, with reference to FIGS. 2 and 3.

Defining the bottom of the cavity. The first pass of the mining pipe or drill pipe 50 through the ore body 36 brings to surface ore cuttings which can be analyzed to ascertain a grade and depth profile. Deployable open hole radiometric tooling or other in-situ instruments can also be used to calculate the grade of the ore 36 for uranium deposits. Once grade and depth is known, a defined bottom of the cavity 60 can be determined based on the mining system cut-off grades. Certain access holes 34 may have several definable top and bottom sections that can be targeted and mined in separate continuous sections within the same access hole 34.

Non-continuous single access hole sections could use the same repeatable methods as described herein.

Jetting. The jetting process utilizes high pressure water piped downhole from surface through mining pipes 50 to a jet sub 58 which houses a nozzle assembly which provides the hydraulic jetting power to disaggregate the cavity face ore. Once the ore 36 is separated from the cavity 60 face the material is forced by gravity acting on the mass to the cavity bottom 62 and sump 64.

The host rock in the target area must be susceptible to cavity generation from the effects of a high pressure water jet with or without an air shroud or with evacuated cavity mining. Depth of the region of excavation must be accessible utilizing water well, mining or oilfield drilling technology to complete the access hole 34, and the water jet operating parameters must be tailored to the depth and excavation area rock type geotechnical characteristics.

Submerged cavity jetting can be performed for the first stage of cavity generation to initially open the cavity 60 to contour 1 (illustrated in FIG. 3) though the presence of the process water medium has an exponential decay effect on the water jet velocity which renders the water jet alone less effective at cavity face disaggregation after a certain distance from the nozzle is reached for cavity opening. At this point air shroud or evacuated cavity methods would be implemented to enhance utility of the jetting activity.

The air shroud encapsulates the water jet with a sheath of high pressure air, effectively reducing the density of the fluid medium through which the water jet is injected. This reduction of the host fluid density surrounding the water jet causes retardation of the exponential decay that is apparent in a water jet within a water submerged higher host fluid density environment. An air shroud allows a greater disaggregation radius than submerged cavity jetting to contours 2, 3 or 4 in FIG. 3. A wellhead or blow out preventer should be mounted on the surface casing to direct and control the release of air shroud air away from the drill rig 20 and rig table 26.

The evacuated cavity technique is the replacement of cavity fluid from pressurized water to pressurized air. When performed at or slightly under equipressure all the process water at or above the suction port(s) is produced to surface, and flow of water into the cavity 60 from the permeable formation is slowed by the pressurized air replacing the water in the cavity. This technique reduces the density of the fluid medium within the cavity 60, thus retarding the decay of the water jet velocity as the jet particles traverse from the nozzle to the cavity face. Use of the evacuated cavity technique is preferred in the exemplary embodiment and is used to increase the rate of cavity face disaggregation beyond that achieved by air shroud jetting to contour 4. Other types of jetting will be known to those skilled in the art and may be applicable in specific circumstances identifiable by the skilled person.

Above the first deck where only casing 46 and casing cement 48 exists in the host rock 44, the jet target shape is a dome 66 with a base at the top of the defined mineralized zone top cut-off 52, the dome curvature target plan being based on geotechnical characteristics of the upper country rock 44, such that the dome shape will provide stability from collapse while the first deck below is excavated.

A deck in the exemplary embodiment has a specified target goal shape determined by adjoining cavity final cavity scans, and where no adjoining cavity exists the target shape is a planar radius determined by the halfway point to the closest access hole casing axis and a vertical height determined by local geotechnical stability.

Located at the bottom of each deck is an inverted conical shape dimensional goal with an angle of repose equal or greater than that of a water saturated target material pile. This inverted cone 62 will act to direct the disaggregated ore to the mining pipe 50 where the suction port(s) and grinder(s) are located, as is described below, and may include a sump 64. Typically the top of the inverted cone is defined as the bottom of the deck 68 above.

Once a first upper deck is excavated and finally cemented for backfill, further domes are not required on the decks below as long as directly located above is high strength cemented fill for support. Another dome 66 may be required if a lower portion of the ore is segregated in vertical distance from the upper cemented decks in the same access hole 34.

The jetting process may initially start with higher jet sub rotational speeds dictated by the minimum of either the mechanical rotational system maximum rotational speed or the optimal traverse speed of the water jet on the cavity face. The water jet vertical velocity may be dictated by the minimum of the optimal distance between subsequent eroded cuts and the vertical velocity allowed by the grinding device at the bottom of the mining pipe bottom hole assembly (BHA) 58.

Figure 3:
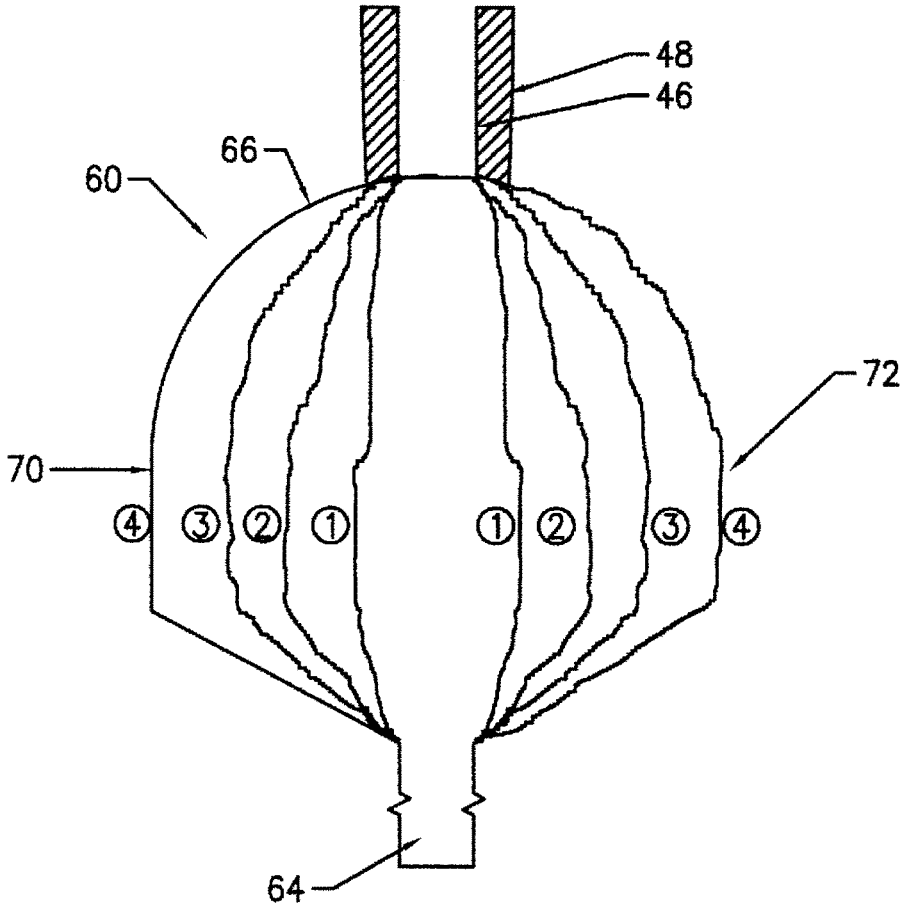
FIG. 3 is a sectional view illustrating outward cavity progression.

The jetting begins rotation and vertical velocity downward at the top of the dome 66 or deck to the bottom 62 of the inverted cone. Once the jet is at the bottom of the defined range the jet sub continues to rotate at the optimal speed and the vertical velocity direction changes in an upward direction. This up-and-down cyclical movement continues while jetting, grinding and suction are working concurrently. The cavity 60 will progress through contours 1 to 4 as illustrated in FIG. 3, contour 4 being the target dimensional contour for the deck; the left side 70 of the cavity 60 illustrates the target contour for the deck in virgin ore, whereas the right side 72 of the cavity 60 illustrates the target contour for the deck side when adjoining to a previously excavated and cemented cavity/deck (the latter contour determined off of a final deck survey of the adjoining cavity excavation prior to cemented fill placement). Interim surveys of the dimensions of the excavation will be undertaken at defined ore production intervals. Once the survey is complete the cycle continues with optimal jet sub kinematics adjusted based on the cavity dimensional feedback until the next survey is performed.

Poor results in cavity dimensional expansion can be expected in the jetting stage in a process water submerged cavity if the nozzle is only able to impact on ore particles that have already been disaggregated from the cavity face; this may be the case if the nozzle is continuously operating at the cavity bottom agitating material and reducing material size. The grinder rather than the jet nozzle should be utilized to reduce the size of the disaggregated ore at the cavity bottom 62 or sump 64 which allows the nozzle to continue to disaggregate at the cavity face, both therefore working in a parallel process.

A water submerged target stope excavation may present a problem when it comes to degrading water jet disaggregation performance. A degraded water jet has a lower cavity face volumetric cuttings removal rate. The degradation problem forms when hydrostatic pressure in fractures and rock pore spaces surrounding the target stope pressurize the target stope excavation with water, creating a submerged target stope. Possible solutions to counter the degrading effect of a submerged cavity include freezing solid, freeze curtain and/or dewatering the region, extendable nozzle arm, evacuation of the cavity or the use of an air shroud. However, most of these possible solutions have undesirable aspects as set out in the following.

The freezing solid solution would require that the target ore body and a defined distance above the ore body be frozen solid with a grid of freeze holes drilled from surface. The grid spacing would be determined by the time required to freeze the formation and the fluid coolant flow rate capacity specifications on surface, and this could freeze the target ore body and enable mining to continue with minimal water jet power decay as compared to a water filled cavity. This alternative is possible although it is high in cost.

The freeze curtain option creates a wall of frozen water within the rock pore spaces; this frozen mass is impermeable and would limit the water inflow into the encased region. If the encased region was dewatered, the mining of the target stopes could occur with little water jet power decay. This alternative is possible but is high in freezing and dewatering costs.

The dewatering only alternative is where the region surrounding the target ore body is dewatered with downhole high capacity pumps which draws down the water table below the target ore body which would enable water jet mining within the cavity to be uninhibited by water in the cavity. This dewatering alternative is high in cost in uranium mining due to the cost of water treatment prior to surface release.

An extending arm can also be used to mechanically move the water jet nozzle closer to the cavity face in order to facilitate increased disaggregation rate of the cavity face with a higher water jet velocity as compared to the situation with no extending arm. This system is mechanically more complex than a nozzle only system within the mining pipe, and due to complexity and possible reliability issues an extendable arm is not the preferred approach.

Given the undesirability of the above possible solutions, an exemplary alternative solution according to the present invention is presented herein including the use of an air shroud or evacuated cavity mining.

Grinding. The mechanical downhole grinder continually operates when mining in an upward velocity or in a downward velocity. The primary function of the grinder is to reduce the ore particle size that is disaggregated from the cavity face in order for the ore to flow through the suction port(s) for production to surface. The secondary function of the grinder is to provide the freedom to position the jet sub vertically where it is required in the cavity, especially to aid in expediting downward velocity of the jet sub to enable the water jet nozzle passes to be an optimal vertical distance apart to optimize disaggregation on the cavity face.

If torque response on the mining string indicates ore piling within the cavity, the grinder can be pulled into a position to allow the piled ore to fall into the sump 64 (open hole drilled beyond the mineralized target zone) where the ore can be subsequently targeted by the grinder into acceptable suction port sizes for production to surface.

Surveying. An initial or subsequent quantity of ore preferably triggers a cavity survey (an interim cavity survey) which utilizes downhole or drop-down dimensional tooling to survey the shape of the cavity 60. This dimensional information is communicated to surface where the resulting shape is used to adjust the jetting plan to ensure that every sector (angle swath for a vertical range) of the cavity 60 has an optimal traverse velocity of the water jet on the cavity face which is translated to an optimal rotational speed of the jet sub which is used in the mechanical rotational control system. Certain sectors can also be targeted for further jet time depending on cavity dimensional progress. After the interim cavity survey the jet sub can be rotated at different rotational speeds within different cavity sectors to optimize the disaggregation rate. This cavity dimensional feedback and control system can be automated by the use of software, although the exemplary embodiment can employ direct human oversight and adjustment if desired.

It should be noted that the inverted cone shape 62 will be difficult to measure on interim surveys because of the disaggregated ore 36 accumulating at this location, but the more important goal is interim survey measurement of the deck 68 from top to bottom. For a final bottom deck survey where measurement of the inverted cone 62 is desired, time with the grinder, suction and jet nozzle should be allocated to producing to surface as much ore 36 from this inverted cone 62 as operationally possible. This process will clear the inverted cone area 62 prior to final cavity dimensional surveying.

Surveying software may be preprogrammed with cavity shape dimensional goals and adjoining cavity contour information. The control system can then limit water jet disaggregation in sectors that are already in contact with adjoining cavity backfill or have reached a planned dimensional goal, thus reducing dilution from an adjoining cavity. Recovery of ore can also be maximized with such a system by focusing more jet time in sectors that have not reached dimensional goals or adjoining cavity contours.

Suction. The suction port or ports are sized to suction ore and fluid from the cavity 60 at velocities that exceed the settling velocities of the ore, which is based primarily on ore particle sizes and densities. The preferred means to restrict oversized ore particles from entering into the suction system is a gate mounted on the intake, but oversized ore particles can periodically plug on the grate face and potentially reduce access. When the suction grate does become plugged, an alternative could be to trip the pipe (pull all the pipe out of the hole), unplug the grate manually and trip all the pipe back into position, but this is not the preferred method for operational efficiency reasons. A grate face clearing nozzle and/or reversing suction line fluid flow is preferred to be used to clear the grate from such plugging. Once the grate is cleared the grinder can reduce the size of the oversized particles.

An air lift system is the preferred means to enable the ore and carrier fluid lifting system. An air lift will reduce the density of the hydrostatic column of water within the suction line; this reduction of density causes a pressure differential between the suction line bottom and the cavity process water. This pressure differential induces flow and causes what is referred to as suction, which will carry ore to surface by lifting the process water and ore faster than a defined velocity which is known by persons skilled in the area of air lift systems.

A downhole jet pump or mechanical pump could be used as alternatives in appropriate circumstances. A jet pump downhole is not the preferred method of generating suction downhole for ore production because the cross sectional area required within the mining pipe would be substantial, although a jet pump could be used if the surrounding water table is substantially lower than the surface level in the area which could hinder air lift effectiveness. A downhole mechanical pump is also not the preferred method to produce ore to surface because the power requirements downhole to operate the pump would be substantial and the mechanical complexity of the bottom hole assembly would increase leading to potential reliability issues which could hinder operations.

Poor results for surface ore production can be expected when the suction ports are not in the bottom section of the cavity 60 to produce the disaggregated ore and ground ore which is primarily located at the cavity bottom 62. Real-time measurements of ore mass flow on surface will allow the operator to properly clean out the majority of the ore in the cavity bottom 62 prior to continuing the up-and-down traverse jet nozzle cycles.

Deck cementing. In the exemplary method, decking is the process of excavating a section of the cavity 60 based on top and bottom targets, then cementing this excavation section after the final deck survey. Cementing is used to give more geotechnical strength to otherwise weak material which could collapse from above when jetting and generating cavity volume. Once an upper deck is cemented and gains sufficient strength (which can be performed quickly by a person skilled in the art of accelerated cementing), the cemented deck can be drilled through and lower deck excavation can continue below the cemented fill of the upper deck. The cemented fill above provides structural support for the excavation below and limits non-mineralized dilution from above. Once each excavation deck is completed, a final survey is performed to be used as target dimensions for adjoining cavity excavations. As is illustrated in FIG. 4, a first deck excavation 74 is undertaken, with an upper dome 66, deck 68 and inverted cone 62 formed in accordance with the above description. Once the first deck excavation 74 is concluded, it is cemented and then drilled through to engage in a second deck excavation 76 lower in the ore body 36. The second deck excavation 76 is in turn cemented and drilled through to engage in the third deck excavation 78, such that (in the illustrated embodiment) all three decks 74, 76, 78 fall within the ore body defined by the upper and lower cut-offs 52, 54.

On the top deck the dome is cemented along with the top deck and its corresponding inverted cone. The inverted cone prior to cementing is operationally difficult to suction to surface completely, but this is of little concern as long as the excavation from the top of the inverted cone to the top of the upper deck is cleared. Once the deck cementing is performed the bottom inverted cone is filled as well, this backfilled inverted cone is targeted in the second deck located under the first deck so the ore is retrieved along with the backfill in this area. Only the lowest deck inverted cone is not targeted in the future, so time should be allocated to effectively grind and suction this lowest inverted cone to maximize ore recovery.

In order to not have poor results from dilution from an adjoining cavity backfill the cemented mix must be engineered with sufficient strength to withstand the effect of disaggregation to an acceptable level caused by the jetting in an adjoining cavity.

Figure 5:
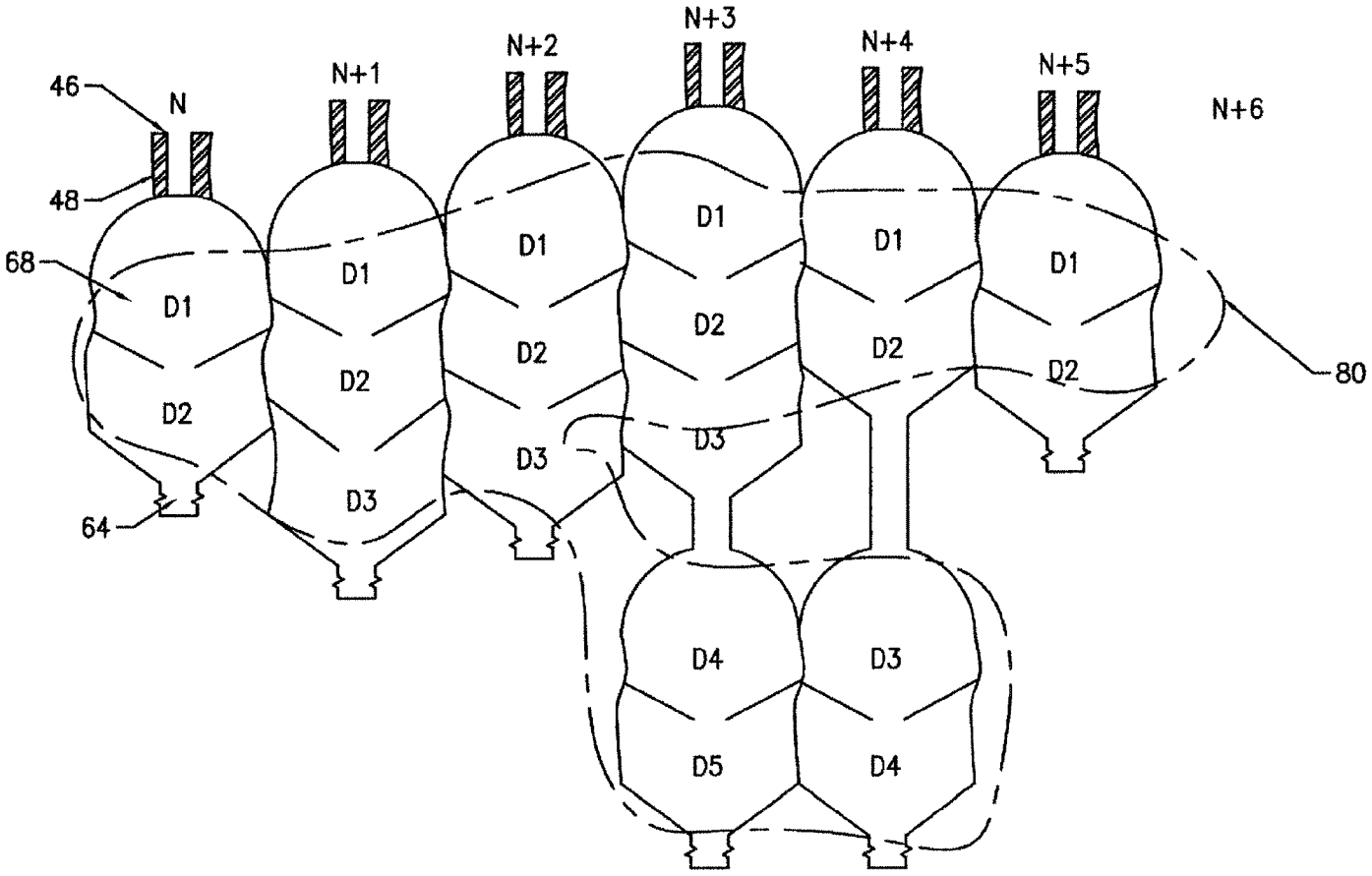
FIG. 5 is a sectional view of an ore body illustrating stacked and laterally developed mining decks.

Ore Body Decking Strategy. Utilizing strategically placed decks, one can attempt to mine an ore body without excess mining of sub-economic mineralized zones. As is illustrated in FIG. 5, for example, an ore body outline for grade cut-off 80 is determined. Access holes N+3 and N+4 have significant vertical spans of sub-economic mineralization. Depending on geotechnical considerations these spans may be bypassed and excavation decking continued at lower elevations in economic mineralization. Access hole N+2 has a region in deck 3 which is hypothesized to be sub-economic, so the exemplary method can focus nozzle induced disaggregation in this area and production ore can be analyzed on surface to confirm if the region is economic or not to mine and if mining can continue. Access hole N+6 did not meet minimum criteria of mass of mineralization, and thus no access hole expenditure is necessary. Excavation of N+5 towards N+6 cuttings can be analyzed on surface to confirm if the N+6 mass of mineralization estimate is correct.

Process Fluids Cycle. High-pressure water is generated on surface with high-pressure pumps and transferred downhole to deliver the high-pressure process water to the downhole water jet nozzle which performs the disaggregation on the face of the cavity, the injected water becoming part of the carrier fluid drawn up the production tubing to surface with the disaggregated ore. Depending on the overall cavity pressure there will be a net water inflow, balance or outflow from the water bearing permeable surrounding formation to the cavity. It is preferred to maintain an overall balance or an overall net water inflow into the cavity from the surrounding formation for environmental reasons. The preferred method to create an underbalanced or balanced cavity which would provide a net water inflow or a water balance respectively is to change the overall cavity pressure by adjusting the suction line lift velocity and/or adjusting the casing—mining pipe annulus area relief pressure.

If the natural ground water level is too low and the use of an air lift system is being implemented it may be difficult depending on all parameters to maintain a process water balanced system, and water may be lost to the formation which may require a different pump to be implemented downhole to ensure a process water balance or process water gain situation, especially in uranium mining.

FIG. 6 illustrates an exemplary process water cycle for use with the present invention. The mining pipe 50 delivers not only high pressure water from high pressure pump(s) 92 to the cavity but other low pressure cavity feed water from low pressure pump(s) 94 in order to facilitate proper lift velocities to lift ore to the surface through the suction line (air lift compressor(s) 98 feed into the system to enable the suction functionalities, while air shroud compressor(s) 96 facilitate the retardation of the water jet velocity exponential decay). The lift of the process water and ore to the surface through the suction line piping is preferred to be performed with an air lift system which provides greater fluid velocity than the settling velocity of the ore which varies primarily with ore density and particle sizes. The three-phase fluid consisting of ore, process water and air flow is carried at surface within piping 30 to the air separator 82. The surface piping 30 shields the surface workers from gamma emissions where radioactive ore is being mined. The ore maintains wetness during the air separation process which can keep radioactive dust emissions from the air separator 82 at very low levels, which is beneficial from a radiation worker protection perspective. The water and ore are then ported through piping 84 to a solids separation system 86 which separates the ore from the process water. The preferred method to separate the ore from the process water is a combination of shaker tables, cyclones and centrifuge units or settling tanks/ponds. The ore is then transferred onto an ore pad 88 where it awaits delivery to stockpiles or a mill.

The process water is then cleared of suspended particulates to the specifications of the system which is primarily based on acceptable wear on the high pressure components. The preferred method to clear the process water of suspended particles is the use of settling tanks or ponds 90 which provide the required settling time to clear the process water to specification. The cleared process water is used as feed water for the high pressure pumps 92 and the cavity feed pump(s) 94 which completes the process water cycle. Excess process water is produced from the cavity 60 while performing mining in an under pressurized environment relative to the surrounding formation pressures, and this process water from holding ponds or tank(s) 90 can be removed from the system for release or treatment and release 100.

Decommissioning. Decommissioning of the site requires excavation of the drill pad and removal of material above the environmentally protective liner (if necessary in the jurisdiction) for proper treatment or disposal.

As can be seen from the above, the present invention as illustrated by means of the exemplary embodiment can be performed in such a way that it manifests significant advantages over the conventional prior art mining methods, namely open-pit mining and underground mining techniques.

For example, initial capital cost outlays prior to production can be significantly less than underground or open-pit mining operations thereby creating an economic incentive to mine ore that would previously be considered non-economic or indicated as sub-economic resources rather than economic reserves. In terms of radiation protection in the case of radioactive ore bodies, the present invention can provide a non-human-entry mining method which distances workers from the mining of the ore. Any ore brought to surface can be contained within piping which provides a barrier against gamma radiation, radon and radioactive dust, thereby reducing radiation exposure relative to underground or open-pit mining of uranium.

The present invention can mine the target area with high pressure water jets that can operate in a water submerged cavity, with water inflow rates significantly reduced due to the low differential pressure between the surrounding rock pore pressure to the cavity pressure. Process water can also be reused throughout the mine life which significantly reduces the costs of water treatment. Since the present invention only targets the mineralized ore body, waste rock piles can be significantly reduced in size, thus reducing the surface environmental disturbance area.

Since the present invention teaches a non-entry mining method, no workers are exposed within the ore body for any part of the mining process and as such water inflows or collapses of geo-technically weak ground does not risk worker safety or underground equipment or infrastructure.

Other advantages would be obvious to those skilled in the art.

The foregoing is considered as illustrative only of the principles of the invention. Thus, while certain aspects and embodiments of the invention have been described, these have been presented by way of example only and are not intended to limit the scope of the invention.

The invention claimed is:

1. A method for excavating a subsurface cavity in a target material to extract a desired part of the target material and produce it to surface, the method comprising:

a. drilling a hole downwardly from surface to at least the depth of the target material;

b. determining a desired cavity geometry;

c. lowering a high-pressure fluid injector downwardly through the hole to a position adjacent to the target material;

d. injecting fluid through the fluid injector outwardly against adjacent target material;

e. allowing the injected fluid to strike and disaggregate the adjacent target material and form the subsurface cavity;

f. measuring cavity dimensions and comparing against the desired cavity geometry;

g. adjusting injection of the injected fluid in response to the comparison to substantially achieve the desired cavity geometry;

h. producing the disaggregated target material to the surface through the hole using a carrier fluid; and i. separating the disaggregated target material from the carrier fluid at the surface.

2. The method of claim 1, wherein the measuring, comparing, and adjusting are repeated a plurality of times until the desired cavity geometry is substantially achieved.

3. The method of claim 1, wherein the injected fluid is the carrier fluid.

4. The method of claim 3, wherein the carrier fluid is reintroduced to the hole as injected fluid after separation from the disaggregated target material.

5. The method of claim 1, wherein the target material comprises a target ore.

6. The method of claim 5, wherein the disaggregated target material is processed at the surface to extract the ore therefrom.

7. The method of claim 1, further comprising after e. but before h. reducing the size of the disaggregated target material to a size suitable for production to the surface.

8. The method of claim 7, wherein reducing the size is accomplished by grinding the disaggregated target material by a grinder downhole of the fluid injector.

9. The method of claim 8, wherein the hole is drilled downwardly to a point below a lowermost extent of the target material to form a sump, the disaggregated material is allowed to settle into the sump, and grinding of the disaggregated target material occurs in the sump.

10. The method of claim 8, wherein a drill bit is the grinder.

11. The method of claim 1, wherein the fluid injector is moved vertically and/or rotationally such that the injected fluid strikes the adjacent target material along a desired path.

12. The method of claim 11, wherein the fluid injector is moved vertically and/or rotationally in repeated sequence.

13. The method of claim 1, wherein the hole is drilled with a drill string having a drill bit at a lowermost extent thereof, and the fluid injector comprises a jet sub having a nozzle on the drill string above the drill bit.

14. The method of claim 13, wherein the cavity dimensions are measured by surveying and the disaggregated target material is produced through production tubing.

15. The method of claim 14, wherein the production tubing is within the hole.

16. The method of claim 15, wherein the disaggregated material is produced by introducing air into the carrier fluid to reduce hydrostatic column density within the tubing and create upward suction of the carrier fluid and disaggregated target material through the production tubing toward the surface.

17. The method of claim 1, wherein the fluid injector comprises an air shroud to enhance disaggregation of the target material.

18. The method of claim 1, further comprising:

withdrawing all downhole equipment from the hole; and backfilling the cavity.

19. The method of claim 18, further comprising drilling through the backfilling to a second lower target material layer and repeating b. through i. for the second lower target material layer.

* * * * *